US005835832A

United States Patent [19]

Rimai et al.

[11] Patent Number: 5,835,832

[45] Date of Patent: Nov. 10, 1998

[54] OPTIMAL TONER CHARGE FOR USE WITH A COMPLIANT TRANSFER INTERMEDIATE

[75] Inventors: Donald S. Rimai, Webster; William K. Goebel; Salvatore Leone, both of Rochester, all of N.Y.

[73] Assignee: Eastman Kodak Company, Rochester, N.Y.

[21] Appl. No.: 883,459

[22] Filed: Jun. 26, 1997

[51] Int. Cl.[6] ..... G03G 15/16

[52] U.S. Cl. ..... 399/308; 399/296; 399/310; 430/109

[58] Field of Search ..... 399/53, 66, 252, 399/253, 296, 297, 302, 308, 310; 430/109, 110, 111, 126

[56] References Cited

U.S. PATENT DOCUMENTS

| | | | |
|---|---|---|---|
| 5,047,802 | 9/1991 | Donivan et al. | 399/53 |
| 5,337,129 | 8/1994 | Badesha | 399/308 |
| 5,666,193 | 9/1997 | Rimai et al. | 399/308 |
| 5,689,787 | 11/1997 | Tombs et al. | 399/308 |
| 5,737,677 | 4/1998 | Tombs et al. | 399/296 |

OTHER PUBLICATIONS

IS&T's Sixth International Congress on Advances in Non-–Impact Printing Technologies, pp. 101–110, published in 1990, in the name of Miskinis.

*Primary Examiner*—Sandra L. Brase
*Attorney, Agent, or Firm*—Norman Rushefsky

[57] ABSTRACT

An improved method and apparatus for robust transfer of toner images using toner particles having a volume average diameter between about 2 $\mu$m and about 9 $\mu$m is described. Surprisingly good electrostatic transfer is obtained when the surface charge density of the toner is between $3.0\times10^{-9}$ coul/cm$^2$ and $6.5\times10^{-9}$ coul/cm$^2$ and when this toner is used in conjunction with a compliant transfer intermediate.

20 Claims, 1 Drawing Sheet

OPTIMAL TONER CHARGE FOR USE WITH A COMPLIANT TRANSFER INTERMEDIATE

FIELD OF THE INVENTION

This invention relates to methods and apparatus for the transfer of electrostatically formed toner images of very small, dry toner particles, for example, particles having a volume weighted average diameter between about 2 $\mu$m and about 9 $\mu$m.

BACKGROUND OF THE INVENTION

In an electrophotographic engine, an electrostatic latent image is formed by first uniformly charging a photoconductive member using a suitable charging technology such as a corona or a roller charger. The charged photoconductive member is then image-wise exposed using either an optical exposure such as a flash lamp or an electronic writer such as a laser scanner or LED array. The electrostatic latent image is then developed into a visible image by passing the latent image bearing photoconducting member through an appropriate electrophotographic developer in a suitable development station. The image is then transferred to a receiver such as paper, transparency stock, etc. by pressing the receiver against the image-bearing photoconducting member in the presence of an electrostatic transfer field, which is generated either by known techniques such as biasing a suitable roller or using a corona charger. The transfer image is then permanently fixed to the receiver by fusing or other suitable, known processes. The photoconducting member is then cleaned and made ready for subsequent image formation.

In generating color images, primary color separations, generally cyan, magenta, yellow, and black in color, are formed by first producing electrostatic latent images on separate frames of the photoconducting member corresponding to the primary colors comprising the final image and subsequently transferring the separations, in register, to the receiver. The art has long recognized the desirability of using very small toner particles, i.e., those having diameters between about 2 $\mu$m and about 9 $\mu$m for producing higher quality images.

However, the transfer of very small, dry toner particles from a photoconductor or other image member to a receiving sheet is extremely challenging. Conventional dry toner transfer is accomplished using an electrostatic field. However, studies on the forces which move small particles indicate that as the particles become smaller, the effect of the electrostatic field is less on a particle compared to the effect of ordinary adhesive forces. This has made conventional transfer using an electrostatic field more difficult the smaller the particle.

The use of intermediates in electrostatic image transfer has been known for many years and has been used commercially in recent years. Examples of electrostatographic apparatus using intermediates are described in U.S. Pat. Nos. 5,084,735; 5,187,526 and 5,370,961. Typically, the toner image is formed on a primary image member, for example, a photoconductive member. The image is transferred from the primary image member to an intermediate image member and then from the intermediate to a receiving sheet. Although this approach has some advantages in single color imaging, it has its greatest advantages in multicolor imaging where the intermediate can be used to receive a number of single-color images in registration to form the multicolor image.

The aforementioned U.S. Pat. No. 5,084,735 to Rimai et al describes that enhanced transfer of toner images may be provided by compliant intermediate transfer members. As described in the prior art and as the term is used herein, a compliant intermediate transfer member has a compliant layer formed on a core or support. The compliant layer has a Young's modulus of between $0.1\times10^7$ Newtons per square meter and $10^7$ Newtons per square meter (10 MPa).

It is preferred to provide a thin hard skin or overcoat upon the compliant layer with the skin having a Young's modulus greater than 50 MPa and preferably greater than 100 MPa.

It is also preferred that the compliant layer and the hard skin be of intermediate conductivity, i.e., resistivity of about $10^8$ ohm-cm to about $10^{10}$ ohm-cm.

To develop the electrostatic latent image it is necessary that the developer particles, hereinafter referred to as "toner", be electrostatically charged. This is generally done by tribocharging the particles by having them contact another surface with a different electronegativity. Appropriate charging materials can be chosen from the well known triboelectric series and such materials for appropriate use in electrophotographic imaging are well known in the art. Although various configurations can be used to tribocharge the toner particles (for example, a skive against which the toner particles are impacted), it is generally advantageous to use a so-called "two-component" developer which is comprised of at least two components: magnetic carrier particles and toner particles. The carrier particles frequently are coated with suitable charge control agents against which the toner particles tribocharge. By careful selection of these agents and their concentration, the surface charge density of the toner particles can be controlled. Additional components such as silica particles, etc. can be added to enhance transfer, cleaning, charge control, etc.

In a typical two-component development process, the toner and carrier are mixed in the sump of a development station. Due to a combination of electrostatic and surface forces, the toner particles adhere to the larger carrier particles. They are then fed onto a brush comprised of a magnetic core and a coaxial shell. Either or both the core and shell are rotated at an appropriate speed. The brush is used to deposit the toner particles onto the electrostatic latent image, thereby producing a visible image. The depleted developer is then returned to the sump where it is mixed with fresh toner particles, thereby preparing it for future development.

As previously discussed, the developed image is transferred by applying electrostatic fields to urge the toner particles from the photoconductor to the receiver or from the photoconductor to an intermediate member and, then, from the intermediate member to the receiver. The resulting electrostatic force on the toner particle, which is essentially the product of the applied electrostatic field and the charge on the toner particle, must be sufficiently large so as to overcome the combined electrostatic image and surface forces holding the toner particle to the photoconductor. As is well known, the strength of the applied electrostatic field is limited by the dielectric strength of air (the so-called Paschen limit), which amounts to approximately $3.0\times10^7$ volts/m for a 10 $\mu$m size air gap. This size is typical of the air gap encountered and arises from variations in toner stack height due to density variations, receiver roughness, toner particle size variations, etc.

Toner charge is also an important parameter in electrophotography. If the charge is too low, the developer can be unstable, resulting in severe dusting and poor development. Moreover, as the electrostatic transfer force is the product of the applied electrostatic field times the toner charge, the applied transfer force might be inadequate to allow transfer to occur. Conversely, if the toner charge is too high, the amount of material deposited on the photoconductor at a given potential will be low. This will result in low density of the developed image. In addition, there is an electrostatic component of the force holding the toner particle to the photoconductor, hereafter referred to as the image force. This varies as the square of the toner charge. Therefore, if the toner charge is too high, the transfer force might not be able to overcome the image force. This problem is further compounded in high density regions where the presence of charged toner particles also serves to reduce the transfer field.

In order to have an effective or robust electrostatic process, i.e., a process that can operate under variable conditions that might be expected for a copier or printer, an optimal value of the toner charge must be chosen. Because toner particles are triboelectrically charged, the optimal toner charge varies with the surface area of the toner particles.

Reference herein to toner particle size or diameter, unless otherwise indicated, means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass. The surface charge density of the toner particles refers to the measured charge-to-mass ratio of those toner particles times the mass of a spherical particle having the same mass density divided by the surface area of the equivalent spherical particle. The charge-to-mass ratio is determined by a device comprised of rotating magnets situated beneath two electrodes, such as the device disclosed by Maher (IS&T's Tenth International Congress on Advances in Non-Impact Printing Technologies, pp. 156–159 published in 1994). In this device the rotating magnets simulate the action of the magnetic development station, with the development field established by biasing the electrodes. For the basis of this disclosure, the term "charge-to-mass ratio" refers to the total charge obtained from a sample of the developer under consideration when essentially all of the toner is stripped from the carrier using this type of device. A developer is considered stripped when the toner concentration of a similar developer, as also determined using this type of device, matches the actual, as prepared sample.

For a typical electrophotographic engine comprised of either a direct electrostatic transfer subsystem or an electrostatic transfer subsystem comprised of a noncompliant transfer intermediate, the optimal surface charge density is typically in the range of $1.0\times10^{-9}$ to $2.0\times10^{-9}$ coul/cm$^2$.

It is an object of the invention to provide for an electrostatographic imaging process wherein a robust transfer method is provided.

SUMMARY OF THE INVENTION

The inventors have found that a robust transfer method is provided wherein the optimal surface charge density of toner particles used in an electrostatophotographic apparatus comprised of a compliant intermediate transfer member is in the range of about $3.0\times10^{-9}$ to about $6.5\times10^{-9}$ coul/cm$^2$. This surface charge density translates into a range of charge-to-mass ratios of about 30 to about 65 $\mu$coul/g for polystyrene toner particles having a volume weighted diameter of 6 $\mu$m.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

The preferred embodiments are described herein with reference to an electrophotographic copier or printer, but it will be understood that the invention can be used in any form of black and white or color electrostatographic copier or printer. The description will be directed in particular to elements forming part of, or cooperating more directly with, the method in accordance with the present invention. It is to be understood that elements not specifically shown or described may take various forms well known to those skilled in the art.

Figure 1:
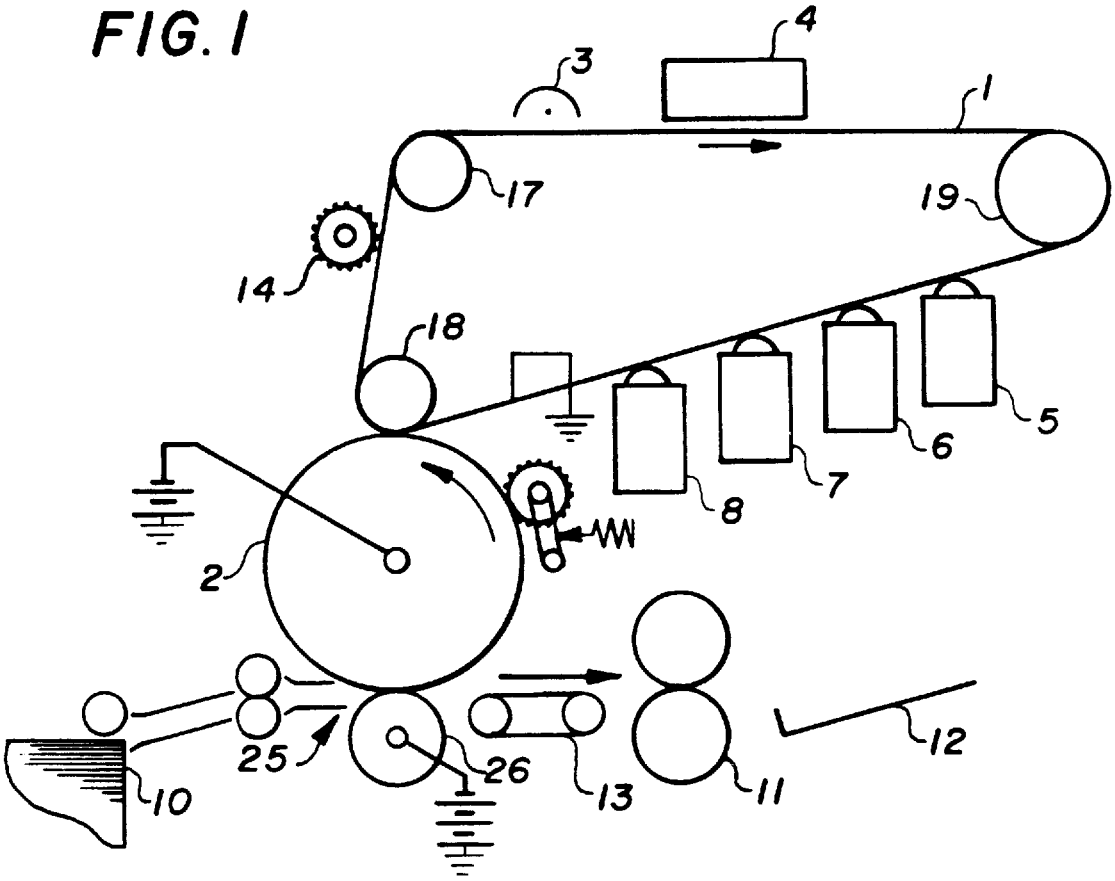
FIG. 1 is a side schematic of a color printer apparatus utilizing the invention.

FIG. 1 illustrates an apparatus in which the invention is intended to be used. A primary image member, for example, a photoconductive web 1 is trained about rollers 17, 18 and 19, one of which is drivable by a drive source such as a motor M to move image member 1 past a series of stations well known in the electrophotographic art. Primary image member 1 is uniformly charged at a charging station 3, imagewise exposed at an exposure station 4, e.g., an LED printhead or laser or other electronic or optical exposure station to create an electrostatic image. The image is toned by one of toner or development stations 5, 6, 7 or 8 to create a toner image corresponding to the color of toner in the station used. The toner image is transferred from primary image member 1 to an intermediate image member, for example, intermediate transfer roller or drum 2 at a transfer station formed between roller 18, primary image member 1 and transfer drum 2. The primary image member 1 is cleaned at a cleaning station 14 and reused to form more toner images of different color utilizing development stations 5, 6, 7 and 8. One or more additional images are transferred in registration with the first image transferred to drum 2 to create a multicolor toner image on the surface of transfer drum 2. In an alternative configuration, the primary imaging member could be a drum.

The multicolor image is transferred to a receiving sheet such as paper or plastic which has been fed from supply 10 into transfer relationship with transfer drum 2 at a transfer nip of a transfer station 25 where the receiving sheet is brought into pressure contact with the image on drum 2. The receiving sheet is transported from transfer station 25 by a transport mechanism 13 to a fuser 1 I where the toner image is fixed by conventional means. The receiving sheet is then conveyed from the fuser 11 to an output tray 12.

The toner image is transferred from the primary image member 1 to the intermediate transfer drum 2 in response to an electric field applied between the core of drum 2 and a conductive electrode forming a part of primary image member 1. The multicolor toner image is transferred to the receiving sheet at a transfer station 25 in response to an electric field created between a backing roller 26 and the transfer drum 2. Thus, transfer drum 2 helps establish both electric fields. As is known in the art, a polyurethane roller containing an appropriate amount of antistatic material to make it of at least intermediate conductivity can be used for establishing both fields. Typically, the polyurethane or other elastomer is a relatively thick layer, e.g. 6 mm thick, which as been formed on an aluminum base. Typically, the electrode buried in primary image member 1 is grounded for convenience in cooperating with the other stations in forming the electrostatic and toner images. If the toner is a positively charged toner, an electrical bias applied to intermediate transfer drum 2 of typically −1,000 to −1,500 volts will effect substantial transfer of toner images to transfer drum 2. To then transfer the toner image onto a receiving sheet at transfer station 25, a bias, e.g., of −2,000 volts is applied to backing roller 26 to again urge the positively charged toner to transfer to the receiving sheet. Schemes are also known in the art for changing the bias on drum 2 between the two transfer locations so that roller 26 need not be at such a high potential.

As noted in Rimai et al, if the intermediate member has a surface of material having release characteristics that are such that the toner prefers or adheres more readily to such surface than to that primary image member 1 and less readily to the surface than the receiving sheet, image artifacts of the nature described are greatly reduced. When operated in the multicolor mode, a cleaning apparatus 30 for cleaning the intermediate transfer drum is moved or pivoted away from the drum 2 to allow transferred images to the drum 2 to be built up in registration with each other. After transfer, the drum 2 is the cleaned by pivoting the cleaning apparatus so that a brush or skive is in contact with the drum 2.

Figure 2:
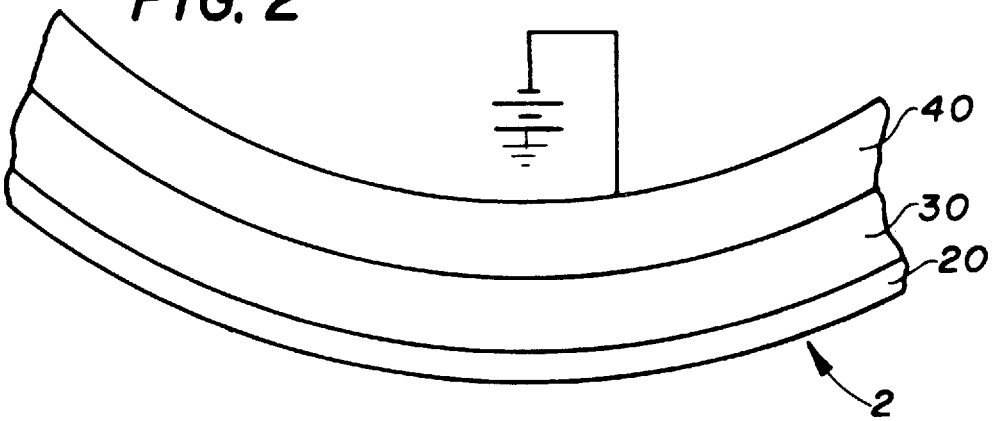
FIG. 2 is a cross-section of a portion of an intermediate transfer roller or drum constructed according to the prior art and forming a part of the invention.

A partial cross-section of a preferred embodiment of such an intermediate member is shown in FIG. 2 in which a roller or drum 2 having a polyurethane base 30 has a thin skin 20 coated or otherwise formed on it having the desired release characteristics. The polyurethane base has an aluminum core 40. The thin skin may be a thermoplastic such as Permuthane produced by Stahl Finish, Inc. The surface of the intermediate member should be relatively hard, preferably having a Young's modulus of $5\times10^7$ Newtons per square meter (50 M Pa) or more to facilitate release of the toner to ordinary paper or another type receiving sheet. As will be seen from the example, the intermediate preferably has a base 30 having a Young's modulus $10^7$ Newtons per square meter (10 MPa) or less to assure good compliance for each transfer.

The difference in optimal surface charge densities for the electrophotographic engines using either direct or noncompliant intermediate transfer technology can be understood in terms of the compliant intermediate reducing or eliminating the air gaps present in the transfer subsystems of those engines not using compliant intermediates. The compliant intermediate effectively serves two purposes: (1) by eliminating air gaps, the toner particles can contact the receiving surface (which can be either the intermediate or the receiver, depending on whether it is the first or second transfer) as well as the donor member. This allows surface forces, which also affect toner adhesion, to be balanced. Accordingly, the applied electrostatic force needed to effect transfer no longer has to solely overcome both adhesion and electrostatic forces and will, accordingly, be different. (2) As stated previously, the Paschen discharge limit varies inversely with the size of the air gap. Accordingly, the reduction of the size of air gaps allows higher transfer fields to be applied.

Of particular benefit is when an electrophotographic apparatus is comprised of a compliant transfer intermediate subsystem and so-called "SPD development" described by Miskinis (IS&T's Sixth International Congress on Advances in Non-Impact Printing Technologies, pp. 101–110 published in 1990). In this process the developer in the respective development stations is comprised of relatively small "hard" magnetic carrier particles (approximately 30 $\mu$m in diameter, as opposed to over 100 $\mu$m in diameter for conventional two-component development systems) which form chains around the development roller in the development station. The term "hard" implies particles having a coercivity of at least 300 oersteds when magnetically saturated and exhibiting an induced magnetic moment of at least 20 EMU/gm of carrier when in an applied field of 1000 oersteds. It is preferred to have carrier having a much higher coercivity in the neighborhood of 2000 oersteds. In this method, developer made up of such hard magnetic carrier particles and oppositely charged insulative, dry toner particles is moved at the speed and direction of the image by high speed rotation of a magnetic core within a shell or sleeve on which the developer moves. It is preferred that the core be comprised of between 8 and 20 permanent magnets rotating between 300 and 1500 rpm. The shell speed is set so that the developer flow rate matches the velocity of the photoconductor. Rapid pole transitions on the sleeve cause the high coercivity carrier to experience a torque. "Strings" or "chains" of the carrier rapidly flip on the sleeve to move the developer on the shell in a direction opposite to that of the rotating core. In contrast, a low coercivity, "soft" magnetic carrier will internally magnetically re-orient in response to the pole transitions and not experience a torque adequate to cause carrier chains to flip. Because carrier particles, to which the toner particles are attached, tend to flip as the magnetic core turns, there is imparted kinetic energy to the toner particles. If the surface charge density of the toner particles is too low, the flipping action of the carrier chains causes the developer to become unstable and the toner particles to form a dust cloud. However, because of the image quality and development efficiency of the SPD process, especially as it relates to relatively small toner particles, and the difficulty of transferring images made with such small dry particles (i.e. those with volume weighted average diameters between about 2 $\mu$m and about 9 $\mu$m), the preferred embodiment of this invention is an electrophotographic engine comprised of a compliant intermediate transfer member and SPD development. Moreover, it is also preferred to use toner particles whose surface has been coated with submicrometer-size particulate addenda, such as silica, titania, various latices, etc., in a manner known in the literature. The toner particles can be produced by any method known in the literature such as grinding, limited coalescence, suspension polymerization, etc.

The structure of the intermediate member 2 has been described in the literature, as cited in the patents by Zaretsky et al U.S. Pat. Nos. 5,187,526 and 5,370,961 and in the aforesaid Rimai et al U.S. Pat. No. 5,084,735, the respective disclosures of which are incorporated by reference within this disclosure. The intermediate can take the form of a web. Preferably, the intermediate is formed by coating a rigid core such as aluminum with an semiconducting elastomer and overcoating the elastomer with a thin layer of a relatively high modulus material. Alternatively, the elastomer can be overcoated with a layer of small, hard particles such as described by Rimai et al.

The preferred method of establishing a specific charge density on toner particles is to mix the toner with carrier particles comprised of a charge agent to a specific concentration of mass of toner to mass of carrier. The concentration of the charge agent on the carrier can be adjusted to vary the toner surface charge density. For example, carrier is often coated with Kynar 301F, a polyvinylidene fluoride made by Pennwalt, Inc. in concentrations from ¼% to 1% by weight of carrier to give polystyrene toner particles a specific surface charge density. Charge agents used to give various charges are known in the literature. Other means of adjusting the toner surface charge density include using a blend of carriers with differing charging characteristics such as disclosed in U.S. Pat. No. 5,512,403 or by varying the toner concentration in the developer.

Alternatively, the surface charge density can be adjusted after the toner has been deposited on the photoconductive member but prior to transfer by exposing the developed image to a suitable charge conditioner such as a grid-controlled corona charger which adds to or reduces the charge on the toner particles laid down as an image so as to bring the surface charge density of the particles to within the range described in this specification.

EXAMPLES

In the following examples, images comprised of neutral density steps from approximately 0.2 to 1.0 density were developed onto a commercially available organic photoconductor commonly used in Kodak Ektaprint 1575/1580 copier/printers manufactured by Eastman Kodak Company, Rochester, N.Y. The developer was comprised of toner having a mean volume weighted diameter of approximately 6.7 $\mu$m, as determined with a Coulter particle size analyzer. The toner was comprised of a polyester matrix containing a pigment and an appropriate charge agent, as are known in the literature, and was prepared using the process of limited coalescence. The toner charge was changed by varying the carrier by varying the concentrations of two carriers, one of which tended to impart a high charge on the toner and the other, a low charge, and was measured using the device and method described previously. The average transfer efficiency from the photoconductive member to a compliant intermediate comprised of an aluminum core over which was coated a polyurethane blanket approximately 0.5 cm thick and having a Young's modulus of approximately 4 MPa and a resistivity of $8.9\times10^{9}$ ohm-cm. The polyurethane blanket was overcoated with a 10 $\mu$m thick layer of a commercial thermoplastic (Permuthane), which has a Young's modulus of 320 MPa. Transfer efficiency was determined by measuring the transmission density of the unfused image and residual after each transfer step.

EXAMPLE 1:

The surface-charge density of a developer was found to be approximately $3.2\times10^{-9}$ coul/cm$^2$ ($3.2\times10^{-5}$ coul/m$^2$). The operating range of transfer voltage for which the transfer efficiency from the photoconductor to the intermediate was over 90% was approximately 1500 volts. The operating range of transfer voltage for which the transfer efficiency from the intermediate to the receiver was over 90% was approximately 1400 volts. The average transfer efficiency, as measured by calculating the area between the actual curve of the transfer efficiency as a function of voltage and the line corresponding to an 80% transfer efficiency was 250 for the first transfer and 210 for the second. These results represent good transfer efficiency and a wide operating latitude. This example is within the specifications of this disclosure.

EXAMPLE 2:

The surface-charge density of a developer was found to be approximately $5.5\times10^{-9}$ coul/cm$^2$. The operating range of transfer voltage for which the transfer efficiency from the photoconductor to the intermediate was over 90% was approximately 1400 volts. The operating range of transfer voltage for which the transfer efficiency from the intermediate to the receiver was over 90% was approximately 1200 volts. The average transfer efficiency, as measured by calculating the area between the actual curve of the transfer efficiency as a function of voltage and the line corresponding to an 80% transfer efficiency was 210 for the first transfer and 200 for the second. These results represent good transfer efficiency and a wide operating latitude. This example is within the specifications of this disclosure.

EXAMPLE 3:

The surface-charge density of a developer was found to be approximately $7.0\times10^{-9}$ coul/cm$^2$. The operating range of transfer voltage for which the transfer efficiency from the photoconductor to the intermediate was over 90% was approximately 400 volts. The operating range of transfer voltage for which the transfer efficiency from the intermediate to the receiver was over 90% was approximately 700 volts. The average transfer efficiency, as measured by calculating the area between the actual curve of the transfer efficiency as a function of voltage and the line corresponding to an 80% transfer efficiency was less than 100 for both the first and second transfers. These results represent poor transfer efficiency and a narrow operating latitude. This example is not within the specifications of this disclosure.

EXAMPLE 4:

A toner similar in size and surface charge density to that commonly used in direct transfer and noncompliant transfer intermediate technology was used in this study. The volume weighted toner diameter was 8.8 $\mu$m and the surface charge density was $1.7\times10^{-9}$ coul/cm$^2$. This toner dusted badly when used in the apparatus described in this disclosure and image quality was poor. This is outside the specifications of this invention.

EXAMPLE 5:

The same toner as was used in Example 4 was also used here. However, the carrier was changed so as to increase the toner surface charge density to $4.1\times10^{-9}$ coul/cm$^2$. This surface charge density is much higher than optimal for electrophotographic engines which do not use compliant intermediates and generally exhibits poor transfer in such engines. In this instance the image developed and transferred well. The operating range of transfer voltage for which the transfer efficiency from the photoconductor to the intermediate was over 90% was approximately 1735 volts. The operating range of transfer voltage for which the transfer efficiency from the intermediate to the receiver was over 90% was approximately 1644 volts. The average transfer efficiency, as measured by calculating the area between the actual curve of the transfer efficiency as a function of voltage and the line corresponding to an 80% transfer efficiency was 288 for the first transfer and 280 for the second. These results represent good transfer efficiency and a wide operating latitude. This example is within the specifications of this disclosure.

Although the invention has been illustrated with reference to electrophotography, the invention is directed to the transfer of toner images and may be useful in electrographic recording and other electrostatic writing applications wherein transfer of the charged toner image to another member is required.

The invention has been described in detail with particular reference to certain preferred embodiments thereof, but it will be understood that variations and modifications can be effected within the spirit and scope of the invention.

What is claimed is:

1. A method of producing an image on an image-receiver comprising:

forming a visible toner image by developing a primary image-forming member with a developer comprised of toner particles having a volume weighted average diameter between about 2 $\mu$m and about 9 $\mu$m and a surface-charge density between $3.0\times10^{-9}$ and $6.5\times10^{-9}$ coul/cm$^2$;

transferring said image from the primary image forming member to a compliant intermediate member by application of an electrostatic field; and transferring said image from said compliant intermediate member to the image-receiver by application of an electrostatic field.

2. The method according to claim 1 wherein color images are produced on the receiver by sequentially transferring color separations in register to the compliant intermediate and subsequently transferring the entire image to the receiver.

3. The method according to claim 1 wherein the developer is comprised of magnetic carrier particles and toner particles.

4. The method according to claim 1 wherein the electrostatic latent image is developed into a visible image using flipping chains of carrier particles during development.

5. The method according to claim 1 wherein the toner particles comprise a submicrometer particulate addenda.

6. The method according to claim 5 wherein the addenda is comprised of silica.

7. The method according to claim 1 wherein the intermediate is comprised of an elastomer.

8. The method according to claim 7 wherein the elastomer is a polyurethane.

9. The method according to claim 1 wherein the intermediate is comprised of an overcoat.

10. The method according to claim 9 wherein the overcoat is a thermoplastic.

11. The method according to claim 9 wherein the overcoat is a ceramer.

12. The method according to claim 9 wherein the overcoat is a sol-gel.

13. The method according to claim 1 wherein the intermediate member has a compliant layer that has a Young's modulus of 10 MPa or less.

14. A method of producing high quality electrophotographic images, comprising:

a. uniformly charging a photoconductive member;

b. image-wise exposing said photoconductive member to produce an electrostatic latent image;

c. producing a visible image by developing said electrostatic latent image with a developer comprised of toner particles having a volume weighted average diameter between about 2 $\mu$m and about 9 $\mu$m and a surface-charge density between $3.0\times10^{-9}$ and $6.5\times10^{-9}$ coul/cm$^2$;

d. transferring said image from the photoconductive member to a compliant intermediate member by application of an electrostatic field; and e. transferring said image from said compliant intermediate to a receiver by application of an electrostatic field.

15. The method according to claim 14 wherein color images are produced by sequentially transferring color separations in register to the compliant intermediate and subsequently transferring the entire image to the receiver.

16. The method according to claim 14 wherein the developer is comprised of hard magnetic carrier particles and toner particles.

17. The method according to claim 16 wherein the electrostatic latent image is developed into a visible image using flipping chains of carrier particles.

18. The method according to claim 14 wherein the carrier particles comprise a mixture of particles with substantially different charging characteristics.

19. A method of producing an image on an image-receiver comprising:

forming a visible toner image by developing a primary image-forming member with a developer comprised of toner particles having a volume weighted average diameter between about 2 $\mu$m and about 9 $\mu$m;

prior to transfer, establishing on the developed toner image a surface-charge density between $3.0\times10^{-9}$ and $6.5\times10^{-9}$ coul/cm$^2$;

transferring said image from the primary image forming member to a compliant intermediate member by application of an electrostatic field; and transferring said image from said compliant intermediate member to the image-receiver by application of an electrostatic field.

20. An apparatus for producing an image on an image-receiver comprising:

a primary image forming member;

a development station positioned to develop the primary image-forming member with a toner to form a toner image, the development station including a developer comprised of toner particles having a volume weighted average diameter between about 2 $\mu$m and about 9 $\mu$m and a surface-charge density between $3.0\times10^{-9}$ and $6.5\times10^{-9}$ coul/cm$^2$;

a compliant intermediate transfer member cooperating with the primary image forming member to form a transfer nip for transferring the toner image to the compliant intermediate transfer member by application of a first electrostatic field within the nip; and a transfer station located relative to the intermediate member to form a transfer nip to transfer said image from said compliant intermediate member to a receiver by application of a second electrostatic field.

* * * * *